US006208230B1

(12) United States Patent
Shiota

(10) Patent No.: US 6,208,230 B1
(45) Date of Patent: Mar. 27, 2001

(54) TRANSFORMER FOR CYCLOCONVERTER

(75) Inventor: Hiromu Shiota, Mie (JP)

(73) Assignee: Kabushiki Kaisha Toshiba, Kanagawa-ken (JP)

( * ) Notice: Subject to any disclaimer, the term of this patent is extended or adjusted under 35 U.S.C. 154(b) by 0 days.

(21) Appl. No.: 09/427,213

(22) Filed: Oct. 26, 1999

(30) Foreign Application Priority Data

Oct. 28, 1998 (JP) ..... 10-307012

(51) Int. Cl.[7] ..... H01F 30/12
(52) U.S. Cl. ..... 336/5; 336/12
(58) Field of Search ..... 336/5, 12; 363/2, 363/4, 5, 64

(56) References Cited

U.S. PATENT DOCUMENTS 3,614,592 * 10/1971 Redfern ..... 363/1
3,882,369 * 5/1975 McMurray ..... 363/79
4,873,478 * 10/1989 Weiss ..... 318/779
5,483,111 * 1/1996 Kuznetsov ..... 310/12

* cited by examiner

*Primary Examiner*—Lincoln Donovan
*Assistant Examiner*—Tuyen Nguyen

(57) ABSTRACT

A transformer for a cycloconverter includes three single-phase transformers connected into a three-phase configuration. Each of the single-phase transformers includes a two-legged core, primary windings wound on at least one of legs of the two-legged core, and twelve secondary windings wound on at least one of the legs of the two-legged core. The secondary windings are connected to positive group converters and negative group converters of a three-phase output circulating current type cycloconverter composed of three single-phase output circulating current type cycloconverters connected in a three-phase configuration. Each of the single-phase output circulating current type cycloconverters includes two positive group converters and two negative group converters arranged in a twelve-pulse bridge configuration. The single-phase transformers include six sets of the secondary windings of the respective phases each of which sets is connected in a delta configuration and other six sets of the secondary windings each of which sets is connected in a wye configuration.

8 Claims, 20 Drawing Sheets

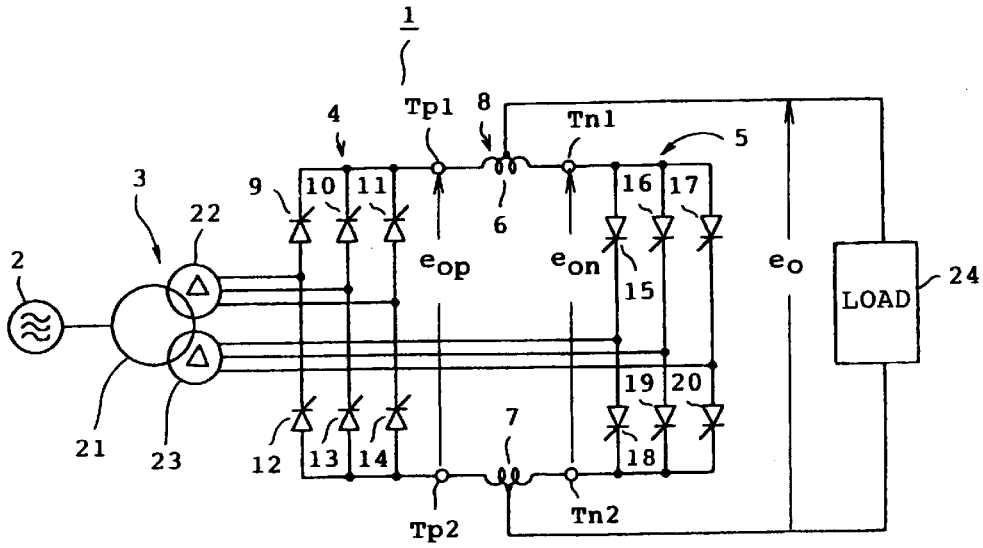
FIG. 10 PRIOR ART
FIG. 11A $e_{op}$ PRIOR ART
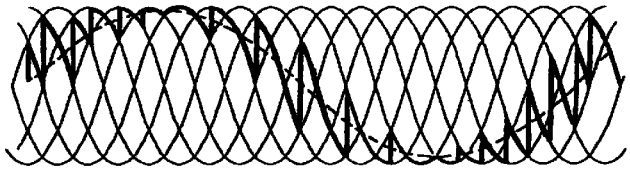
FIG. 11B $e_{on}$ PRIOR ART
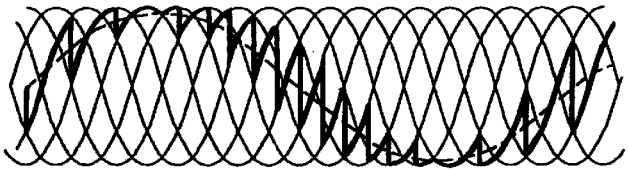
FIG. 11C $e_o$ PRIOR ART
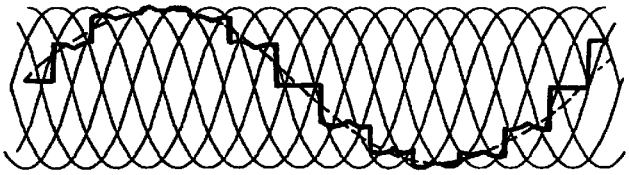

TRANSFORMER FOR CYCLOCONVERTER

BACKGROUND OF THE INVENTION

1. Field of the Invention

This invention relates to a transformer suitable for use in a power supply for a three-phase output circulating current type cycloconverter having a twelve-pulse bridge arrangement.

2. Description of the Prior Art

FIGS. 10, 11A, 11B and 11C, and 12 illustrate a basic arrangement of a conventional single-phase output circulating current type cycloconverter 1. Referring to FIG. 10, an electrical arrangement of the cycloconverter 1 is shown. The cycloconverter 1 comprises a three-phase transformer 3 connected to a three-phase alternating current (AC) power supply 2 and a converter section 8 including a positive group converter 4 and a negative group converter 5 both of which are connected via circulating current limiting reactors 6 and 7 in reverse parallel to each other. The positive group converter 4 comprises six thyristors 9 to 14 connected into a three-phase bridge configuration, whereas the negative group converter 5 comprises six thyristors 15 to 20 connected into a three-phase bridge configuration. The transformer 3 includes a primary winding 21 connected in a three-phase configuration and two secondary windings 22 and 23 each of which is connected in a delta configuration, for example. One secondary winding 22 is connected to input terminals of the positive group converter 4, whereas the other secondary winding 23 is connected to input terminals of the negative group converter 5. A load 24 is connected between neutral points of the reactors 6 and 7.

In the above-described cycloconverter 1, gate signals having predetermined patterns are supplied to the thyristors 9 to 14 of the positive group converter 4 and the thyristors 15 to 20 of the negative group converter 5, respectively. As a result, substantially sinusoidal voltages $e_{op}$ and eon as shown by bold solid lines in FIGS. 11A and 11B are generated between output terminals Tp1 and Tp2 of the positive group converter 4 and between output terminals Tn1 and Tn2 of the negative group converter 5, respectively. A substantially sinusoidal voltage $e_o$, which is equal to a mean value of the voltages $e_{op}$ and $e_{on}$ as shown by bold solid line in FIG. 11C, is obtained between both terminals of the load 24. Each of thin solid lines in FIGS. 11A to 11C shows a voltage of the three-phase AC power supply 2. Broken lines in FIGS. 11A to 11C show fundamental wave components of the voltages $e_{op}$, $e_{on}$ and $e_o$ respectively.

The input voltage is thus supplied into the cycloconverter 1 from the three-phase AC power supply 2 when the gate signals are supplied to the thyristors 9 to 20 respectively. A power supply frequency of the input voltage is directly converted to a lower frequency in a predetermined range such that a single-phase AC voltage is delivered. Accordingly, the cycloconverter 1 serves as a frequency converting circuit.

FIG. 12 shows another conventional cycloconverter 25 including a converter section 26. The converter section 26 comprises a positive group converter including a first positive group converter 27*a* and a second positive group converter 27*b* both of which are connected to each other so as to form a cascade. The converter section 26 further comprises a negative group converter including a first negative group converter 28*a* and a second negative group converter 28*b* both of which are connected to each other so as to form a cascade. Each of the positive group converters 27*a* and 27*b* has the same arrangement as the above-described positive group converter 4, and each of the negative group converters 28*a* and 28*b* has the same arrangement as the above-described negative group converter 5.

A three-phase transformer 29 includes primary windings 30*a* and 30*b*, a first positive group winding 31*a* and a first negative group winding 32*a* both of which serve as secondary windings corresponding to the primary winding 30*a* as shown in FIG. 14. The transformer 29 further includes a second positive group winding 31*b* and a second negative group winding 32*b* both of which serves as secondary windings corresponding to the primary winding 30*b*, as shown in FIG. 14. The first positive and negative group windings 31*a* and 32*a* are connected to the first positive and negative group converters 27*a* and 28*a* respectively. The second positive and negative group windings 31*b* and 32*b* are connected to the second positive and negative group converters 27*b* and 28*b* respectively.

For example, each of the first positive and negative group windings 31*a* and 32*a* is connected in a delta configuration, and each of the second positive and negative group windings 31*b* and 32*b* is connected in a wye configuration. This arrangement results in a phase difference of 30 degrees between the first and second converters of the positive and negative groups respectively. Accordingly, the cycloconverter 25 reduces harmonic components of the output voltage $e_o$ more than the cycloconverter 1. The converter section 8 of the cycloconverter 1 has a six-pulse bridge arrangement, whereas the converter section 26 of the cycloconverter 25 has a twelve-pulse bridge arrangement. The above-described cycloconverter 25 is connected in a three-phase configuration such that a three-phase output cycloconverter 33 having the twelve-pulse bridge arrangement as shown in FIG. 13 is composed.

Various transformer arrangements have conventionally been used for the above-described cycloconverter 33 in the prior art. FIG. 13 shows one of the prior-art transformer arrangements. The above-described three transformers 29 are provided in the respective phase converter sections 26. FIG. 14 shows a winding arrangement for one of legs of an iron core of each transformer 29. More specifically, on an upper portion of one leg 34*p* of a three-legged core 34 are wound an innermost first positive group winding 31*a*, a primary winding 30*a* and an outermost first negative group winding 32*a* in this order as viewed in FIG. 14. Further, on a lower portion of the leg 34*p* are wound an innermost second positive group winding 31*b*, a primary winding 30*b* and an outermost second negative group winding 32*b* in this order as viewed in FIG. 14.

The primary windings 30*a* and 30*b* are connected in parallel to each other and further connected to the respective primary windings 30*a* and 30*b* wound on the other two legs (not shown) each in a three-phase configuration, further connected to the three-phase AC power supply 2. Furthermore, the first positive and negative group windings 31*a* and 32*a* are connected to the respective first positive and negative group windings 31*a* and 32*a* of the other two legs each in a delta configuration. The second positive and negative group windings 31*b* and 32*b* are connected to the respective second positive and negative group windings 31*b* and 32*b* of the other two legs each in a wye configuration.

FIG. 15 shows an electrical arrangement of another prior-art cycloconverter 35. The cycloconverter 35 is constructed so that two three-phase transformers 36*a* and 36*b* apply predetermined AC voltages to the respective phase converter sections 26. FIG. 16 shows a winding arrangement for one of legs of an iron core of the transformer 36*a*. More specifically, on an upper portion of one leg 37*p* of a three-legged core 34 are wound an innermost first positive group winding 31*a*, a primary winding 30*a* and an outermost first negative group winding 32*a* in this order as viewed in FIG. 16. Further, on a middle portion of the leg 37*p* are wound an innermost first positive group winding 31*a*', a primary winding 30*a*' and an outermost first negative group winding 32*a*' in this order as viewed in FIG. 16. Additionally, on a lower portion of the leg 37*p* are wound an innermost first positive group winding 31*a*", a primary winding 30*a*" and an outermost first negative group winding 32*a*" in this order as viewed in FIG. 16.

The primary windings 30*a*, 30*a*' and 30*a*" are connected in parallel to one another and further to primary windings 30*a*, 30*a*' and 30*a*" of the other two legs (not shown) each in a three-phase configuration. The secondary windings 31*a*, 31*a*' and 31*a* " are connected to respective secondary windings 31*a*, 31*a*' and 31*a*" of the other two legs each in a delta configuration and further to first positive group converters 27*a* of the respective phases. The secondary windings 32*a*, 32*a*' and 32*a*" are connected into a delta configuration in the same manner as described above and further to first negative group converters 28*a* of the respective phases. The transformer 36*b* has the same arrangement as described above except that the secondary windings 31*b*, 31*b*', 31*b*", 32*b*, 32*b*' and 32*b*" are connected in a wye configuration.

FIG. 17 shows an electrical arrangement of further another prior-art cycloconverter 38. The cycloconverter 38 is constructed so that a single three-phase transformer 39 applies a predetermined AC voltage to each phase converter section 26. FIG. 18 shows a winding arrangement for one of legs of an iron core of the transformer 39. More specifically, on an upper portion of one leg 40*p* of a three-legged core 40 are wound the same windings as those wound on the upper portion of the leg 37 of the above-described transformer 36*a* (see FIG. 16). Further, on a lower portion of the leg 40*p* are wound the same windings as those wound on the lower portion of the leg of the above-described transformer 36*b*.

In each of the aforesaid transformers 29, 36*a*, 36*b* and 39, each primary winding is interposed between the positive and negative group windings such that these windings are magnetically coupled close with one another. Accordingly, a load current flows into the primary windings during energization to either positive or negative group windings as disclosed in Japanese Patent Application Publication No. 63-186564A published on Aug. 2, 1988. Consequently, since a ratio of use of the primary windings to the secondary windings is improved, a total capacity of the primary windings can be rendered $1/\sqrt{2}$ times smaller than a total capacity of the secondary windings. Further, the three-legged cores 34 and 40 are excited by a twelve-pulse current through an overall period in the respective transformers 29 and 39. Consequently, harmonics can be reduced as compared with a case where the core is excited by a six-pulse current and accordingly, a core loss can also be reduced.

Consider a case where sets of the positive group windings, primary windings and negative group windings wound on the legs 34*p*, 37*p* and 40*p* of the transformers 29, 36*a* (36*b*) and 39 of the respective conventional cycloconverters 33, 35 and 38 have the same dimensions. In this case, an amount of core material used is rendered smaller as the number of transformers is decreased, and with this, no-load loss is reduced. The arrangement of the cycloconverter 38 as shown in FIG. 17 is superior in this respect.

Further, all the secondary windings 31*a*–32*b*" of the transformer 39 of the cycloconverter 38 are wound on the single three-legged core 40 so as to form the same magnetic circuit with the core. Accordingly, the core 40 is excited by the twelve-pulse current through the overall period including a period in which the positive group converters 27*a* and 27*b* supply positive half-cycle voltages and a period in which the negative group converters 28*a* and 28*b* supply negative half-cycle voltages. As a result, the transformer 39 has an advantage that the core loss is reduced. This also applies to each of the transformers 29 of the cycloconverter 33 having the first and second positive group windings 31*a* and 31*b* and the first and second negative group windings 32*a* and 32*b*.

However, the above-described transformer 39 has twelve secondary windings per leg. With respect to the middle leg 40*q*, a space utilized to extend lead wires is limited to two opposite directions as shown in FIG. 19 which is a schematic plan view of the transformer 39. As a result, it is difficult to extend the twelve lead wires regarding the middle leg 40*q*. Accordingly, the arrangement of the transformer 39 has not been employed hitherto.

On the other hand, the transformer 36*a* of the cycloconverter 35 as shown in FIG. 15 has the secondary windings 31*a* to 32*a*" connected to the first positive and negative group converters 27*a* and 28*a* of the respective phases. Further, three secondary windings 31*a* of the respective phases are connected in the delta configuration. All the other secondary windings 32*a* to 32*a*" of the respective phases are also connected each in the delta configuration. Accordingly, the transformer 36*a* is excited by the six-pulse current through the overall period and accordingly has a disadvantage that the core loss is increased. This also applies to the transformer 36*b*.

In view of the above-described disadvantage, the prior art has proposed a cycloconverter 41 having a modified arrangement of the secondary windings of the transformers 36*a* and 36*b* as shown in FIG. 20. A transformer 42*a* of the cycloconverter 41 includes parallel connected primary windings 30*a*, 30*a*' and 30" of the respective phases, first positive group windings 31*a*, 31*a*' and 31" of the respective phases and first negative group windings 43*a*, 43*a*' and 43*a*" of the respective phases. The first positive group windings 31*a* of the respective phases are connected in a delta configuration. The other first positive group windings 31*a*' and 31*a*" of the respective phases are each connected in a delta configuration, too. The first negative group windings 43*a* of the respective phases are connected in a wye configuration. The other first negative group windings 43*a*' and 43*a*" of the respective phases are each connected in a wye configuration, too. Further, a transformer 42*b* also includes second negative group windings 43*b*, 43*b*' and 43*b*" of the respective phases which are each connected in the delta configuration instead of the wye configuration. According to the above-described arrangement, a circulating current flowing into the cycloconverter 41 is a twelve-pulse current. However, since this circulating current component is small, each of the transformers 42*a* and 42*b* is still excited by the six-pulse current and the core loss cannot be reduced much.

To overcome the above-described drawback, the prior art has further proposed a cycloconverter 44 having a further modified arrangement of the secondary windings of the transformers 42*a* and 27*b* as shown in FIG. 21. The transformer 45*a* includes secondary windings connected to the positive group converters 27*a* and 27*b* of the respective phases. More specifically, the transformer 45*a* includes parallel connected primary windings 30*a*, 30*a*' and 30*a*" of the respective phases, first positive group windings 31*a*, 31*a*' and 31*a*" of the respective phases which are each connected in a delta configuration, and second positive group windings 31*b*, 31*b*' and 31*b*" of the respective phases which are each connected in a wye configuration. Further, a transformer 48*b* also includes first negative group windings 43*a*, 43*a*' and 43*a*" of the respective phases which are each connected in the wye configuration and second negative group windings 43*b*, 43*b*' and 43*b*" of the respective phases which are each connected in the delta configuration. Consequently, each of the transformers 45*a* and 45*b* is excited by a twelve-pulse current through the overall period. However, a required total capacity of the primary windings of each transformer is equal to a total capacity of the secondary windings. This renders the size of each transformer larger than those of the above-described transformers 36*a*, 36*b*, 42*a* and 42*b* and accordingly increases the manufacturing cost of the cycloconverter.

SUMMARY OF THE INVENTION

Therefore, an object of the present invention is to provide a transformer for a cycloconverter which has such a construction that a transformer core is excited by a twelve-pulse current through the overall period and lead wires can readily be extended and which can reduce the total capacity of primary windings.

The present invention provides a transformer for a cycloconverter comprising three single-phase transformers connected into a three-phase configuration. Each of the single-phase transformers comprises a two-legged core, primary windings wound on at least one of legs of the two-legged core and twelve secondary windings wound on at least one of the legs of the two-legged core. The secondary windings are connected to positive group converters and negative group converters of a three-phase output circulating current type cycloconverter composed of three single-phase output circulating current type cycloconverters connected in a three-phase configuration. Each of the single-phase output circulating current type cycloconverters includes two positive group converters and two negative group converters arranged in a twelve-pulse bridge configuration. The single-phase transformers include six sets of the secondary windings of the respective phases each of which sets is connected in a delta configuration and other six sets of the secondary windings each of which sets is connected in a wye configuration.

According to the above-described transformer, the two-legged core can be used in each single-phase transformer. With respect to either leg, lead wires of the primary and secondary windings can readily be extended in three directions other than a direction of the other leg. Further, all of the twelve secondary windings connected to the positive and negative group converters arranged in the twelve-pulse bridge are wound in each single-phase transformer. Consequently, since each single-phase transformer is excited by a twelve-pulse current, the core loss can be reduced.

Three transformers are required in the above-described arrangement as in the foregoing first conventional arrangement. However, the three three-phase transformers are used in the first conventional arrangement, whereas the three single-phase transformers are used in the present invention. Consequently, since an amount of core material used for each transformer can be reduced, the size of each transformer can be reduced and no-load loss can be decreased.

BRIEF DESCRIPTION OF THE DRAWINGS

Other objects, features and advantages of the present invention will become clear upon reviewing the following description of the preferred embodiments, made with reference to the accompanying drawings, in which:

FIG. 10 is an electrical connection diagram of a conventional single-phase output circulating current type cycloconverter with six pulse bridge arrangement;

FIGS. 11A, 11B and 11C are voltage waveform charts at respective portions of the cycloconverter shown in FIG. 10;

DETAILED DESCRIPTION OF THE PREFERRED EMBODIMENTS

Figure 12:
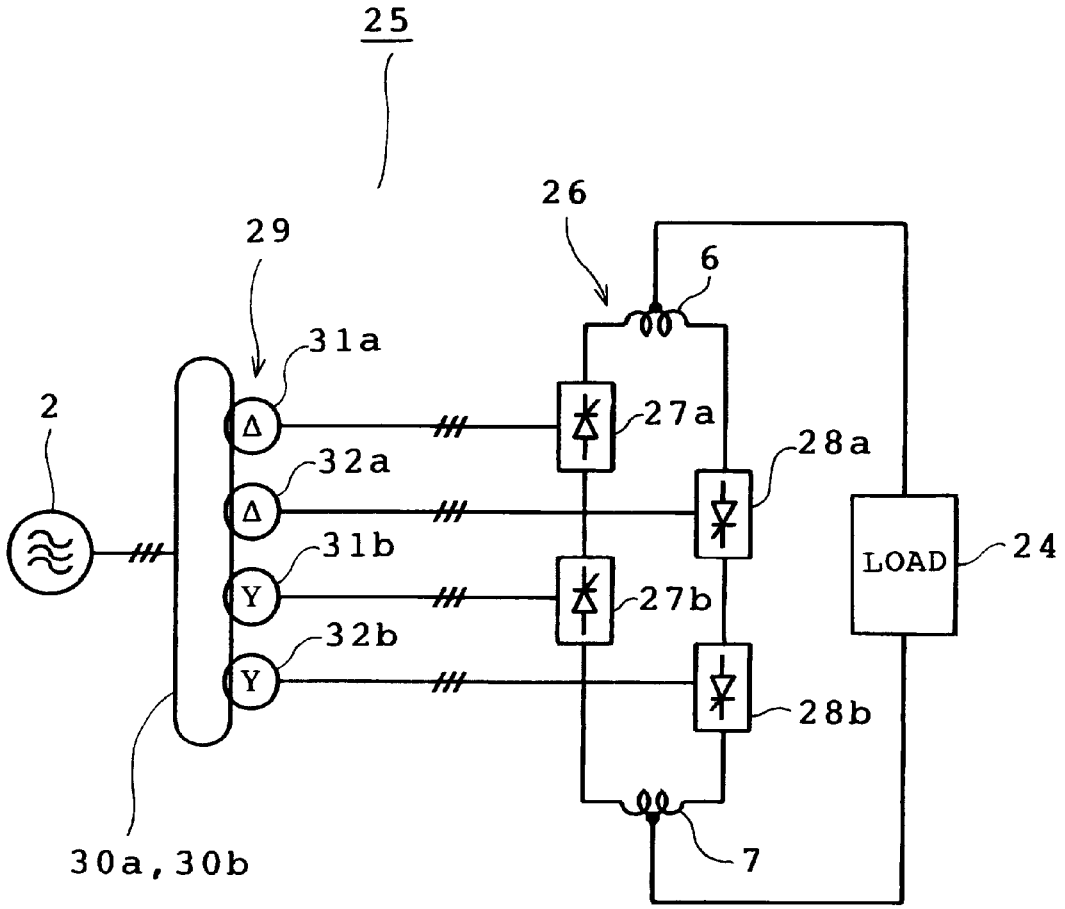
FIG. 12 PRIOR ART
FIG. 12 is an electrical connection diagram of another conventional single-phase output circulating current type cycloconverter with twelve pulse bridge arrangement.

A first embodiment of the present invention will be described with reference to FIGS. 1 to 6C. Identical or similar parts in the arrangement of FIG. 1 are labeled by the same reference symbols as in the arrangement of FIG. 12 and the description of these parts are eliminated.

Figure 1:
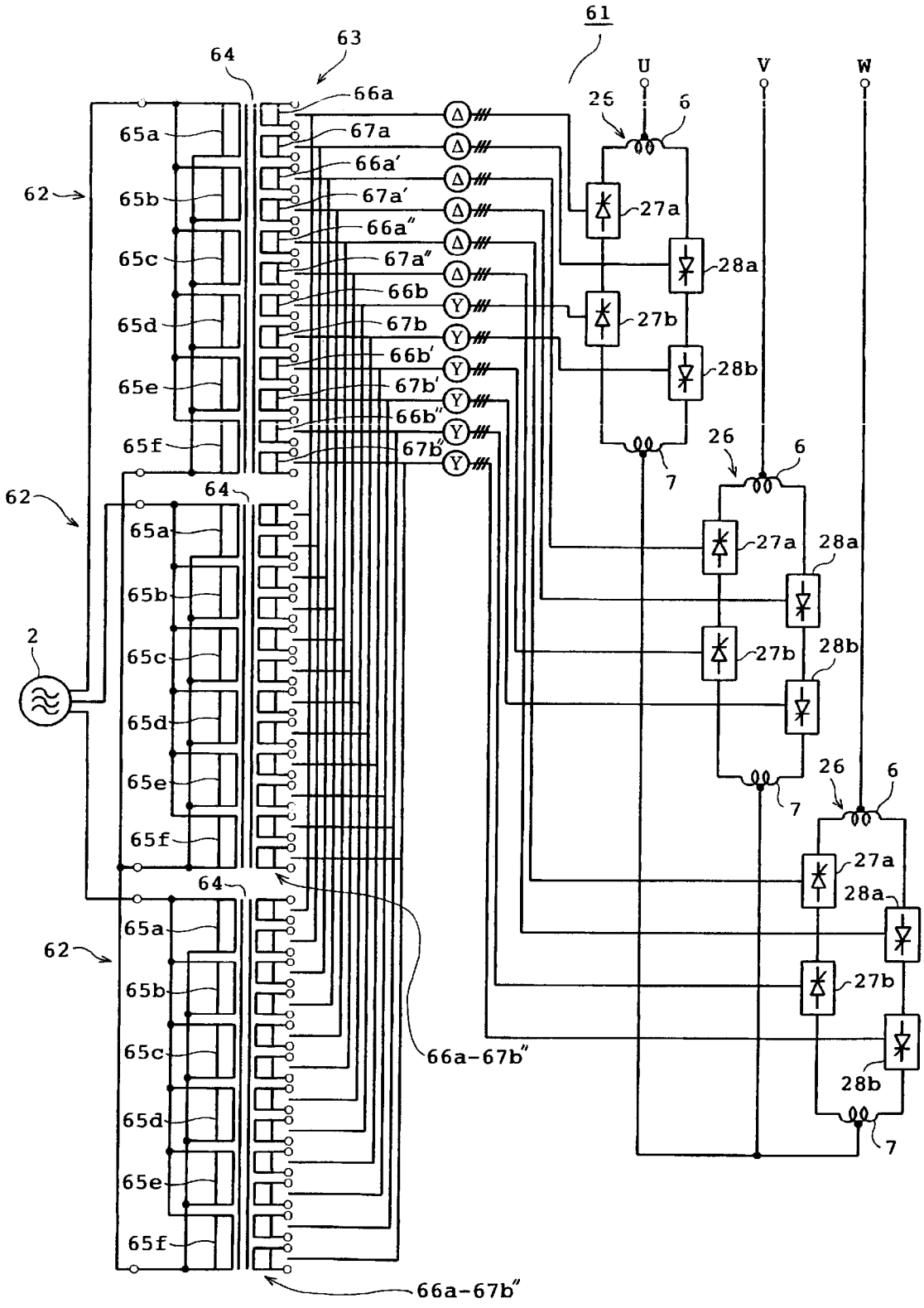
FIG. 1 is a circuit diagram showing an electrical arrangement of a three-phase output circulating current type cycloconverter in which three single-phase transformers of a first embodiment in accordance with the present invention is used.

Referring to FIG. 1, an electrical arrangement of a three-phase output circulating current type cycloconverter 61 in which the transformer of the embodiment is employed is shown. The cycloconverter 61 comprises three converter sections 26 connected in a three-phase, for example wye, configuration, a cycloconverter transformer including three single-phase transformers connected in a three-phase configuration. Each converter section 26 has a twelve-pulse bridge configuration.

Each single-phase transformer 26 comprises a two-legged core 64, six primary windings 65*a*, 65*b*, 65*c*, 65*d*, 65*e* and 65*f* wound on legs of the core 64, and twelve secondary windings 66*a*, 67*a*, 66*a*', 67*a*', 66*a*", 67*a*", 66*b*, 67*b*, 66*b*', 67*b*', 66*b*" and 67*b*" wound on the legs of the core 64. The connection of the secondary windings of each single-phase transformer 62 is simplified in FIG. 1. However, for example, concerning the phase U converter section 26, three windings 66*a* of the respective single-phase transformers 62 are connected in a delta configuration to serve as a first positive group winding which is connected to a first positive group converter 27*a*. Further, three windings 67*a* of the respective single-phase transformers 62 are connected in a delta configuration to serve as a first negative group winding which is connected to a first negative group converter 28*a*. Three secondary windings 66*b* of the respective single-phase transformers 62 are connected in a wye configuration to serve as a second positive group winding which is connected to a second positive group converter 27*b*. Three secondary windings 67*b* of the respective single-phase transformers 62 are connected in the wye configuration to serve as a second negative group winding which is further connected to a second negative group converter 28*b*. The above-described arrangement is also applied to each of phase V and W converter sections 26. The primary windings 65*a* to 65*f* of each single-phase transformer 62 are connected in parallel with one another so as to be extended as two lead wires, being connected to a three-phase, for example wye, configuration together with lead wires of the other two single-phase transformers 62. The lead wires are then connected to a three-phase AC power supply 2.

Figure 2:
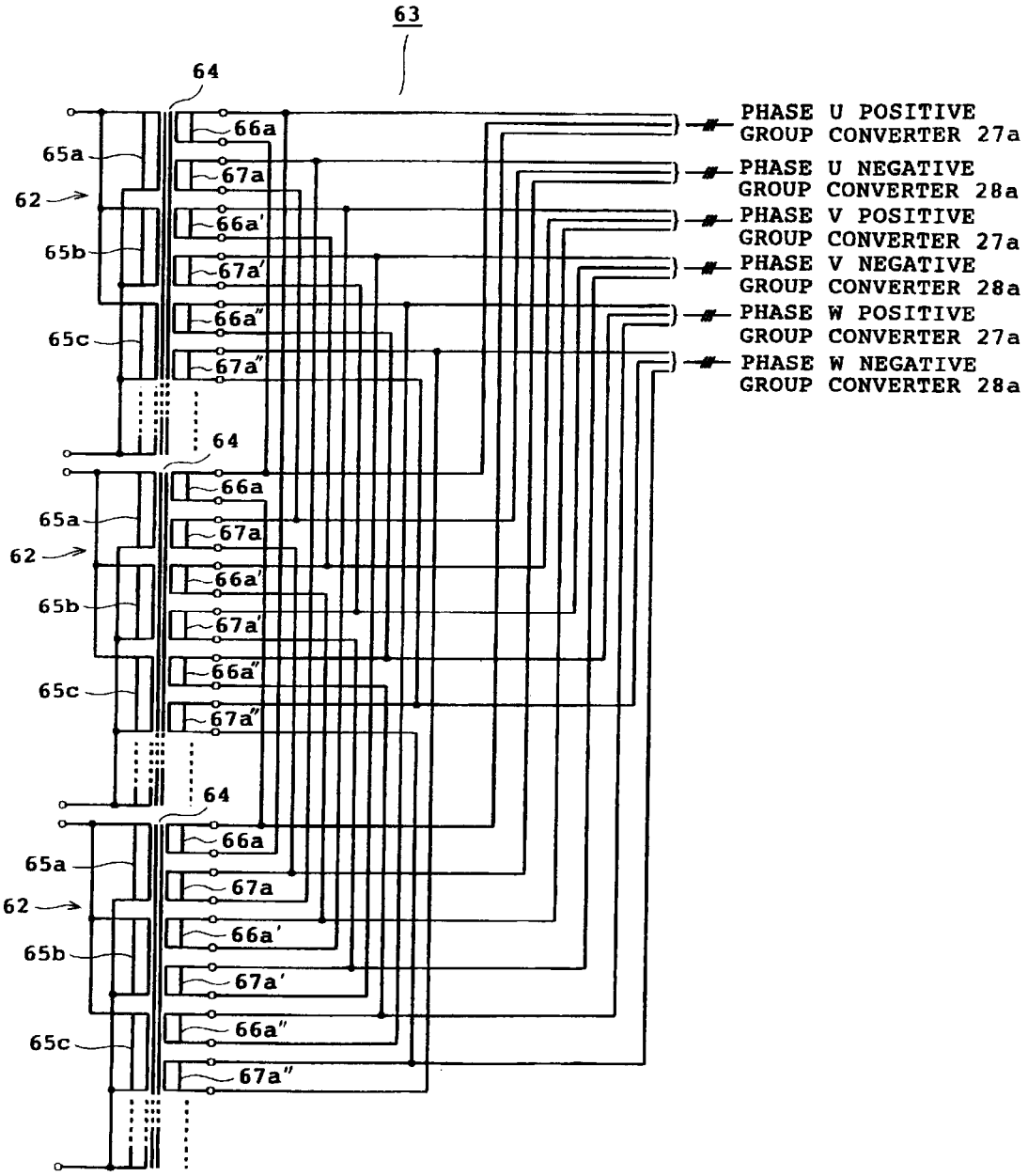
FIG. 2 is an electrical connection diagram of secondary windings of the single-phase transformers.
Figure 3:
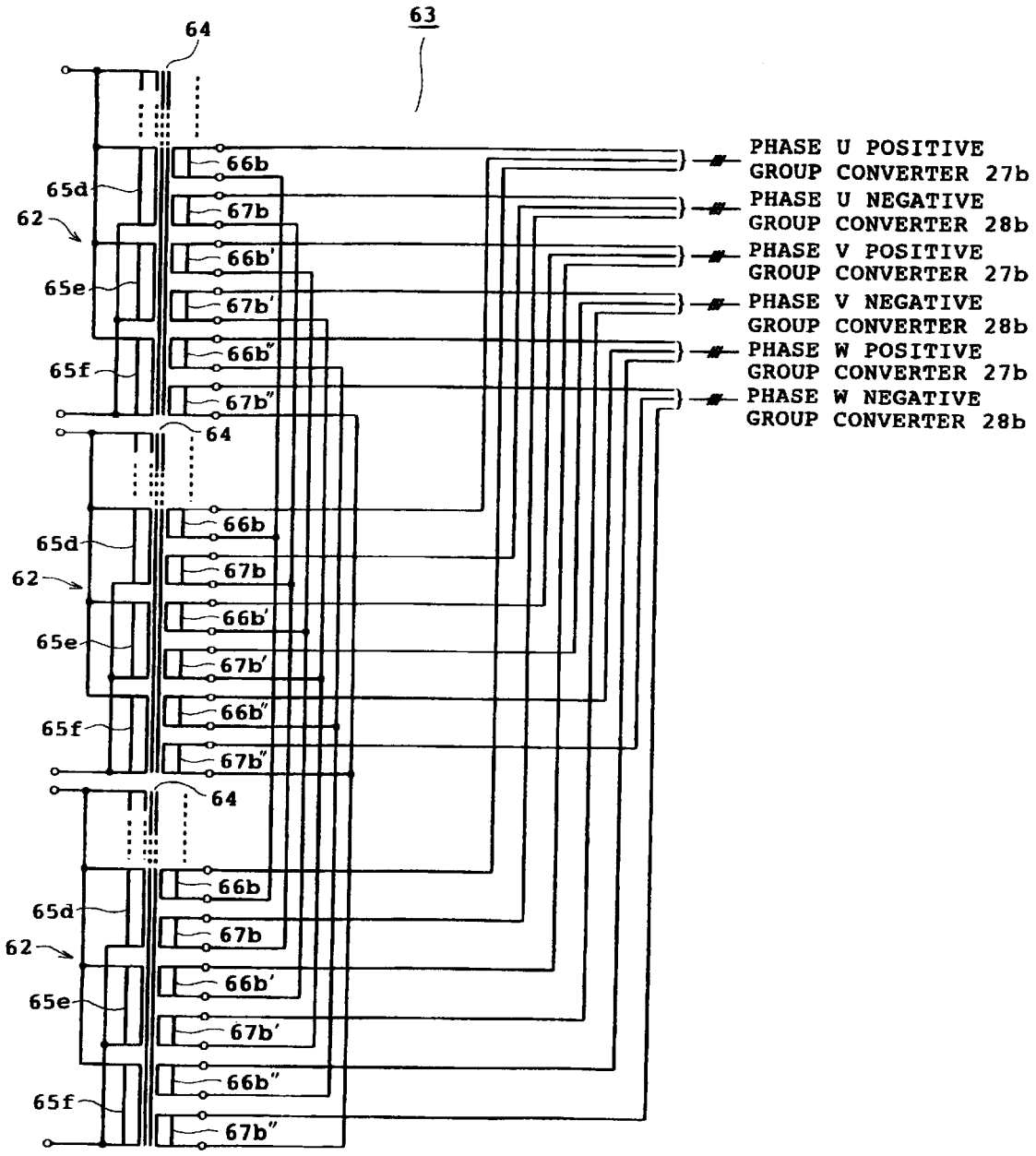
FIG. 3 is also an electrical connection diagram of the other secondary windings of the single-phase transformers.

FIG. 2 shows in detail the delta connection of the secondary windings 66*a*, 67*a*, 66*a*', 67*a*', 66*a*" and 67*a*" of the respective single-phase transformers 62. FIG. 3 shows in detail the wye connection of the secondary windings 66*b*, 67*b*, 66*b*', 67*b*', 66*b*" and 67*b*" of each single-phase transformer 62.

Figure 4:
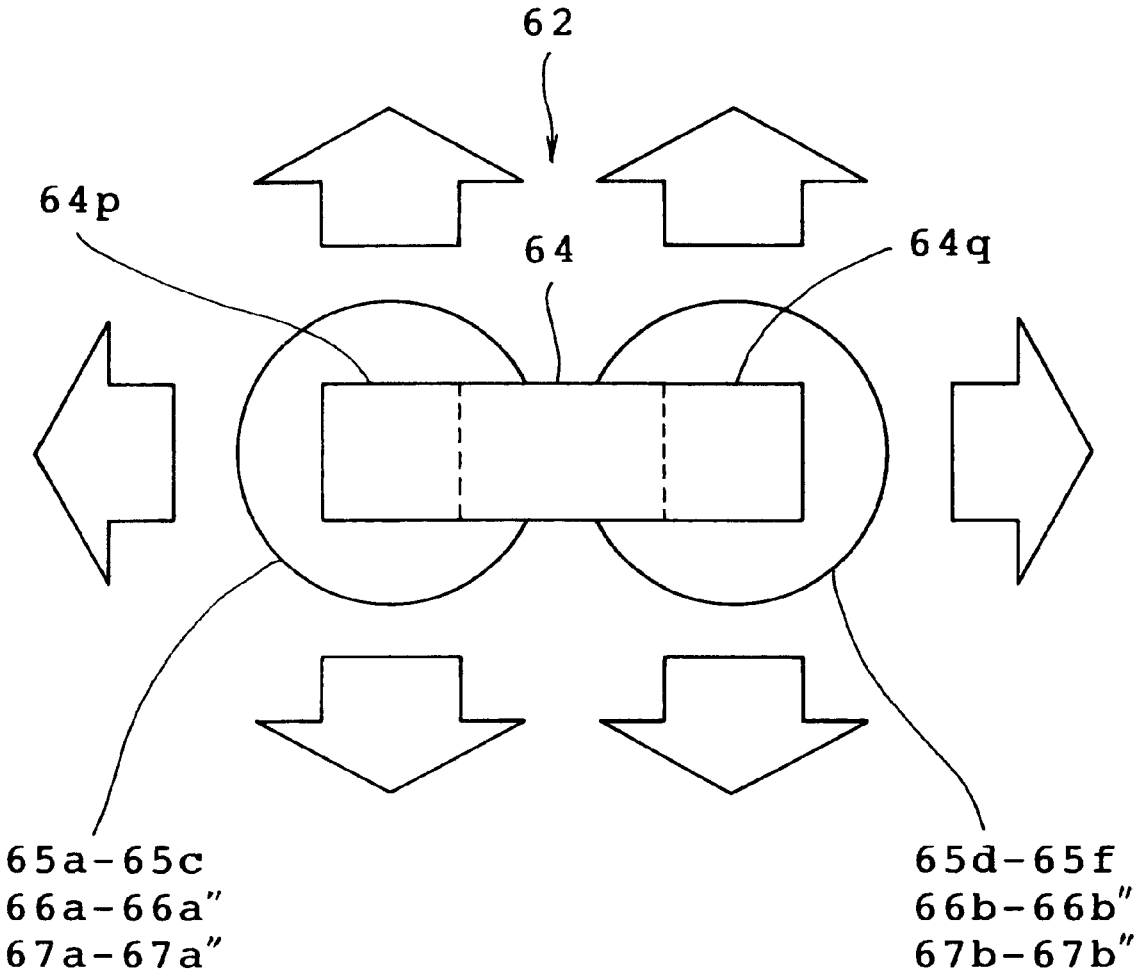
FIG. 4 is a schematic plan view of one of the single-phase transformers.
Figure 5:
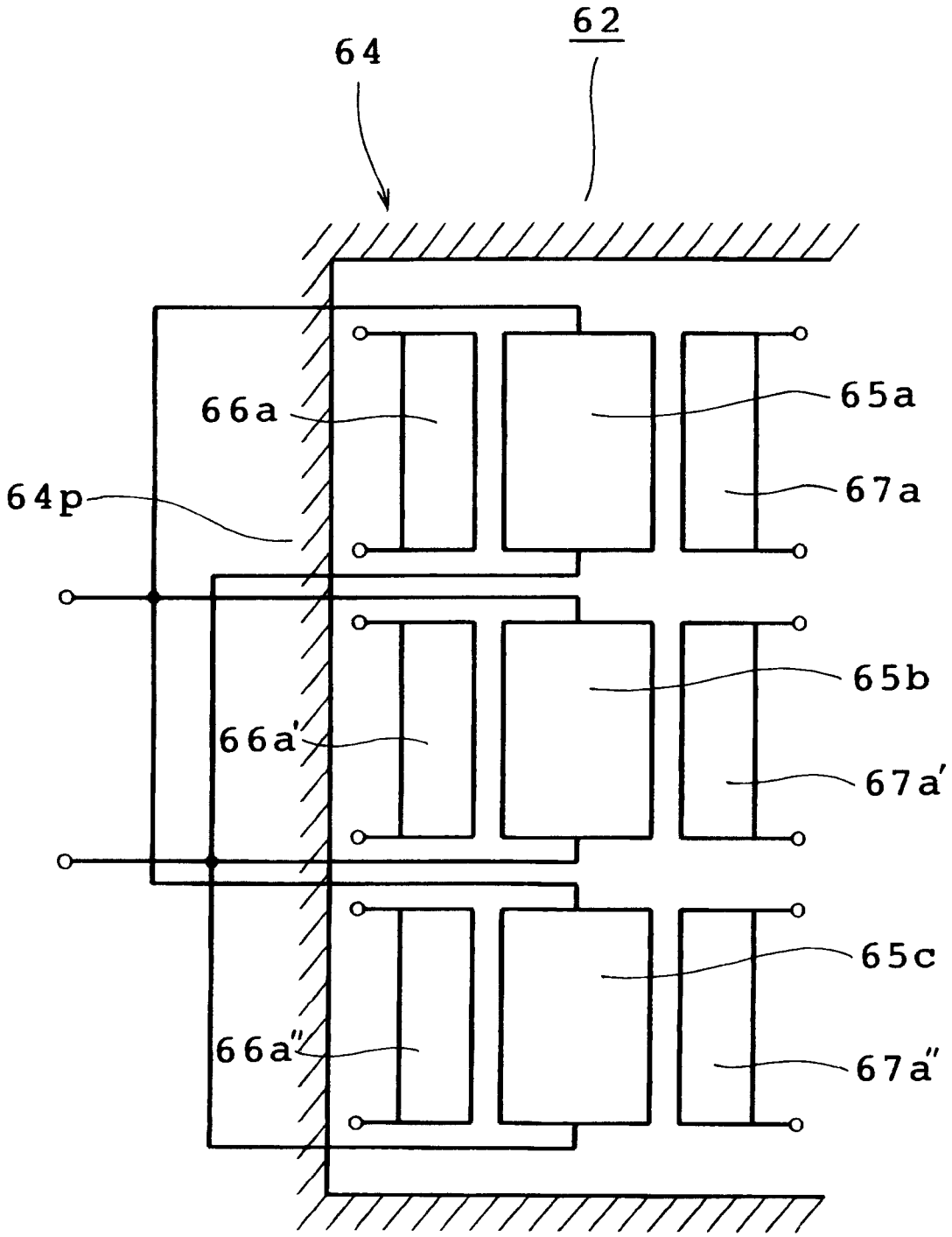
FIG. 5 is a diagrammatic longitudinally sectional view of one leg of the core of one single-phase transformer, showing an arrangement of the windings in the one leg.

In each single-phase transformer 62, three of the primary windings 65*a* to 65*f* are wound on one leg 64*p* of the two-legged core 64, whereas six of the secondary windings 66*a* to 67*b*" are wound on the other leg 64*q* of the core, as shown in FIG. 4. FIG. 5 shows a winding arrangement for the leg 64*p* of the two-legged core 64. More specifically, on an upper portion of the leg 64*p* are wound an innermost first positive group winding 66*a*, a primary winding 65*a* and an outermost first negative group winding 67*a* in this order as viewed in FIG. 5. Further, on a middle portion of the leg 64*p* are wound an innermost first positive group winding 66*a*', a primary winding 65*b* and an outermost first negative group winding 67*a*' in this order as viewed in FIG. 5. Additionally, on a lower portion of the leg 64*p* are wound an innermost first positive group winding 66*a*", a primary winding 65*c* and an outermost first negative group winding 67*a*" in this order as viewed in FIG. 5.

Further, the other leg 64*q* also has the same winding arrangement as described above with respect to the leg 64*p* although the winding arrangement of the leg 64*q* is not shown. More specifically, on an upper portion of the leg 64*q* are wound an innermost second positive group winding 66*b*, a primary winding 65*d* and an outermost second negative group winding 67*b* in this order. Further, on a middle portion of the leg 64*q* are wound an innermost second positive group winding 66*b*', a primary winding 65*e* and an outermost second negative group winding 67*b*' in this order. Additionally, on a lower portion of the leg 64*q* are wound an innermost second positive group winding 66*b*", a primary winding 65*f* and an outermost second negative group winding 67*b*" in this order. Alternatively, the windings may be wound on each of the legs 64*p* and 64*q* in the order of the negative group winding, the primary winding and the positive group winding from the inside.

Figure 13:
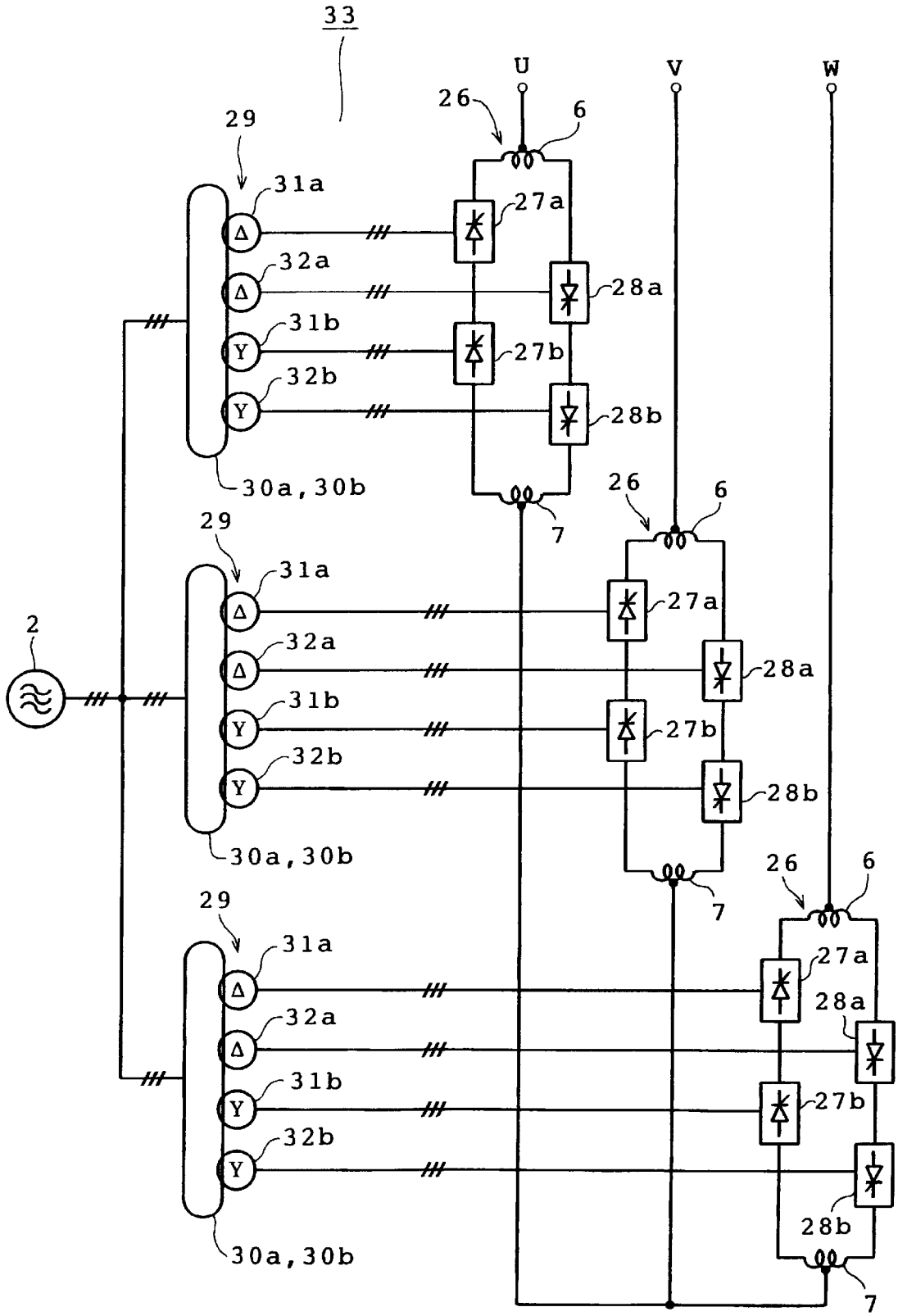
FIG. 13 PRIOR ART
FIG. 13 is an electrical connection diagram of a prior art three-phase output cycloconverter comprising three cycloconverters shown in FIG. 12.

Each of the three single-phase transformers 62 constituting the cycloconverter transformer 63 includes the two-legged core 64. The lead wires can be extended from the legs 64*p* and 64*q* in three directions as shown in FIG. 4. In particular, one half of the primary windings 65*a* to 65*f* are wound on one leg 64*p*, whereas the other half of the primary windings are wound on the other leg 64*q*. Further, one half of the secondary windings 66*a* to 67*b*" are wound on one leg 64*p*, whereas the other half of the secondary windings are wound on the other leg 64*q*. Consequently, the structure for extending the lead wires can be simplified and accordingly the manufacturing cost can be reduced. Further, since the cycloconverter transformer 63 comprises the three single-phase transformers 62, an amount of core material used in the transformer 63 can be reduced as compared with the prior art cycloconverter transformer comprising the three three-phase transformers as shown in FIG. 13.

Figure 6A:
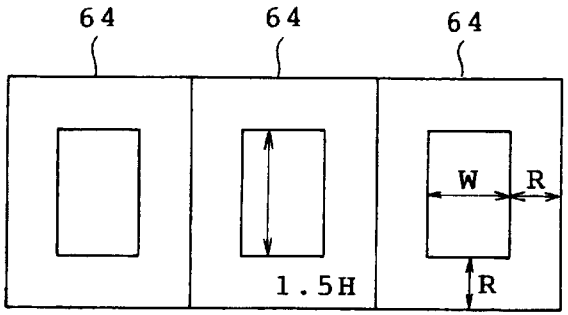
FIGS. 6A, 6B and 6C are schematic front views of the transformers.
Figure 6B:
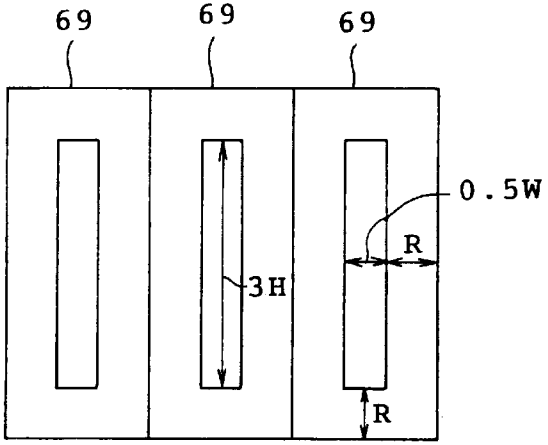
Figure 6C:
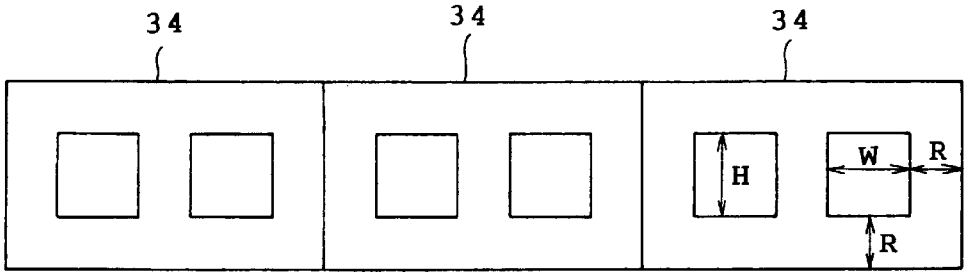
Figure 14:
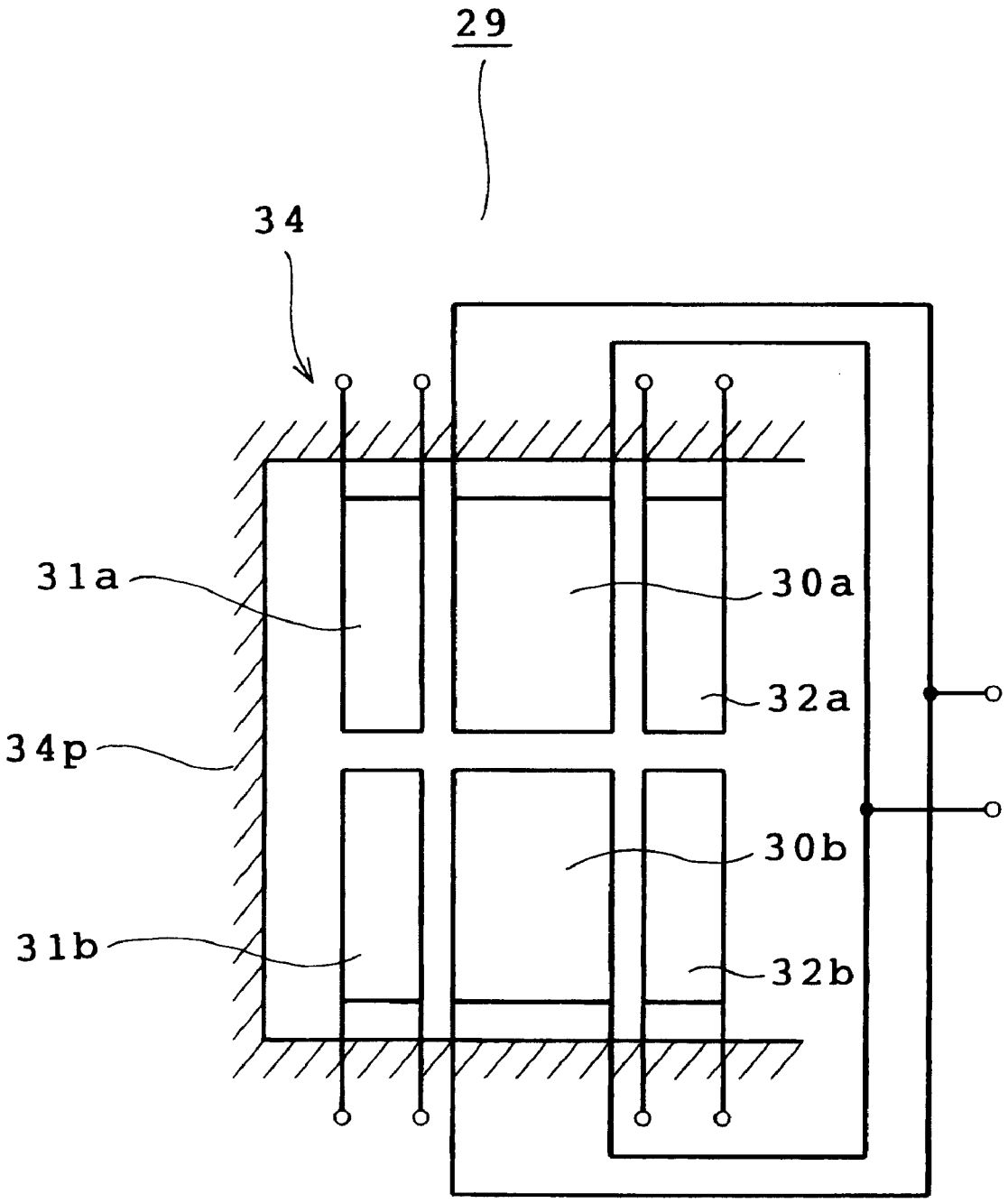
FIG. 14 PRIOR ART
FIG. 14 is a diagrammatic longitudinally sectional view of one leg of the core of one of the transformers used in the cycloconverter shown in FIG. 13, showing an arrangement of the windings in the one leg.
Figure 15:
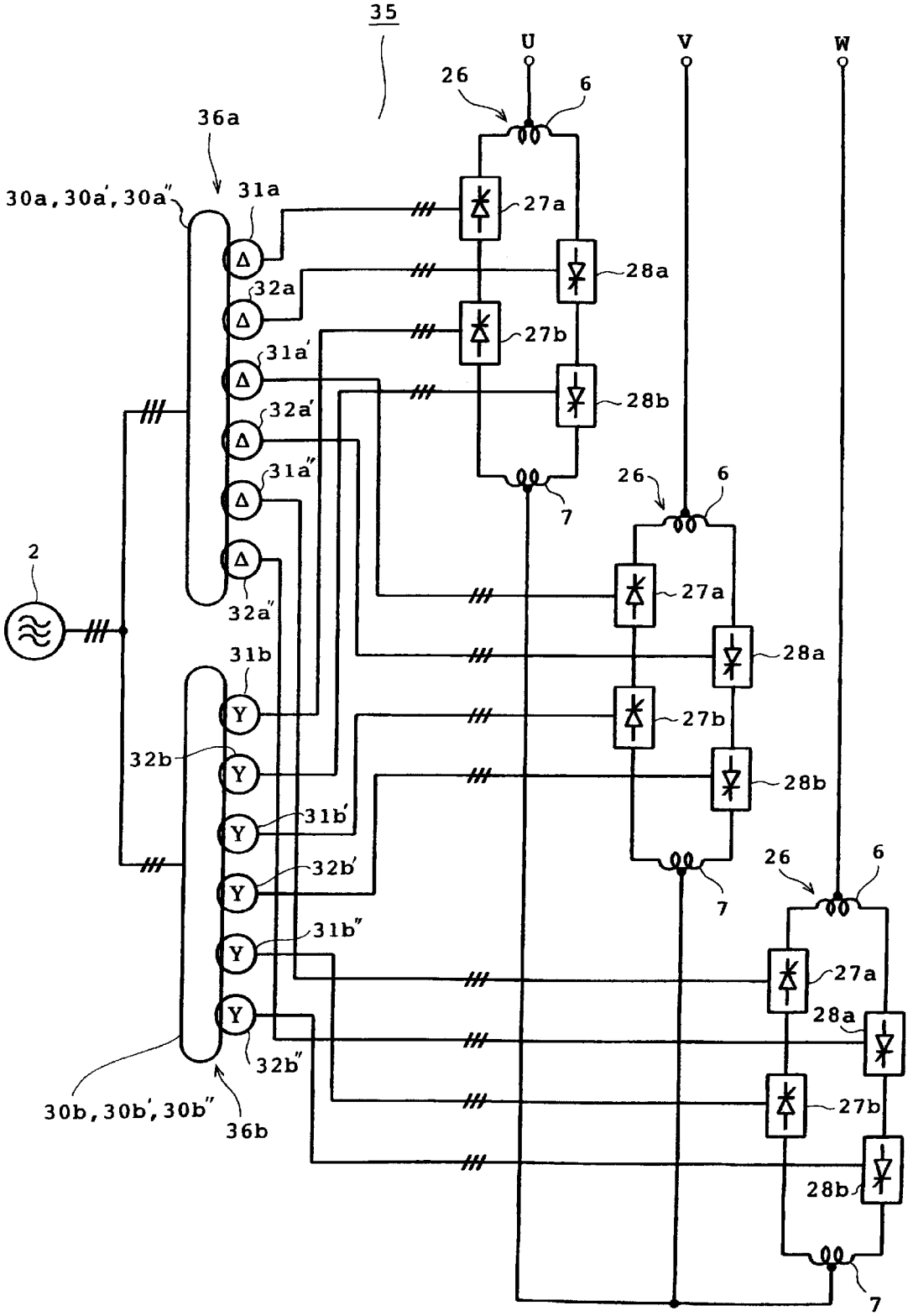
FIG. 15 PRIOR ART
FIG. 15 is an electrical connection diagram of another prior art three-phase output cycloconverter having a transformer arrangement differing from that shown in FIG. 13.
Figure 16:
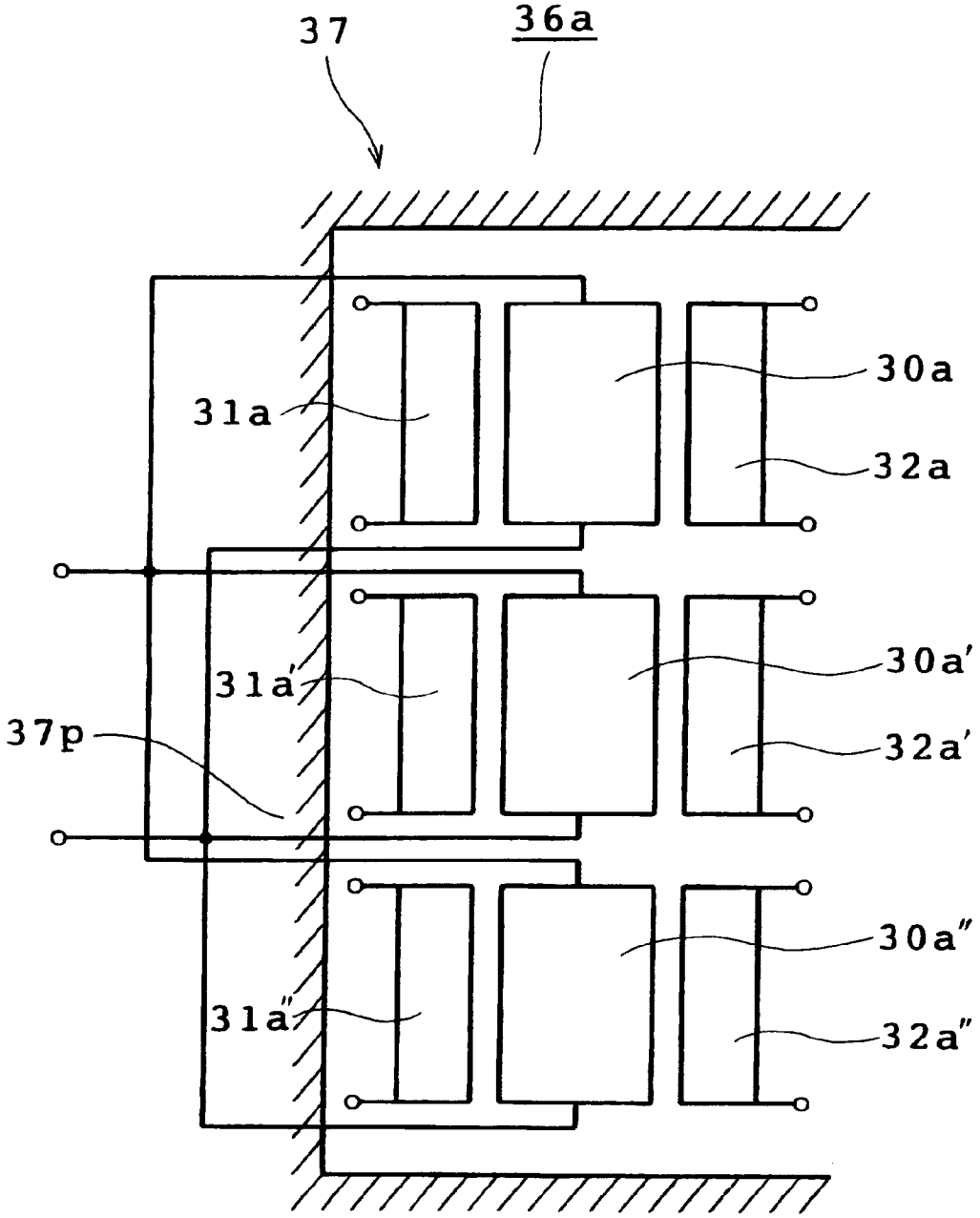
FIG. 16 PRIOR ART
FIG. 16 is a diagrammatic longitudinally sectional view of one leg of the core of one of the transformers used in the cycloconverter shown in FIG. 15.
Figure 17:
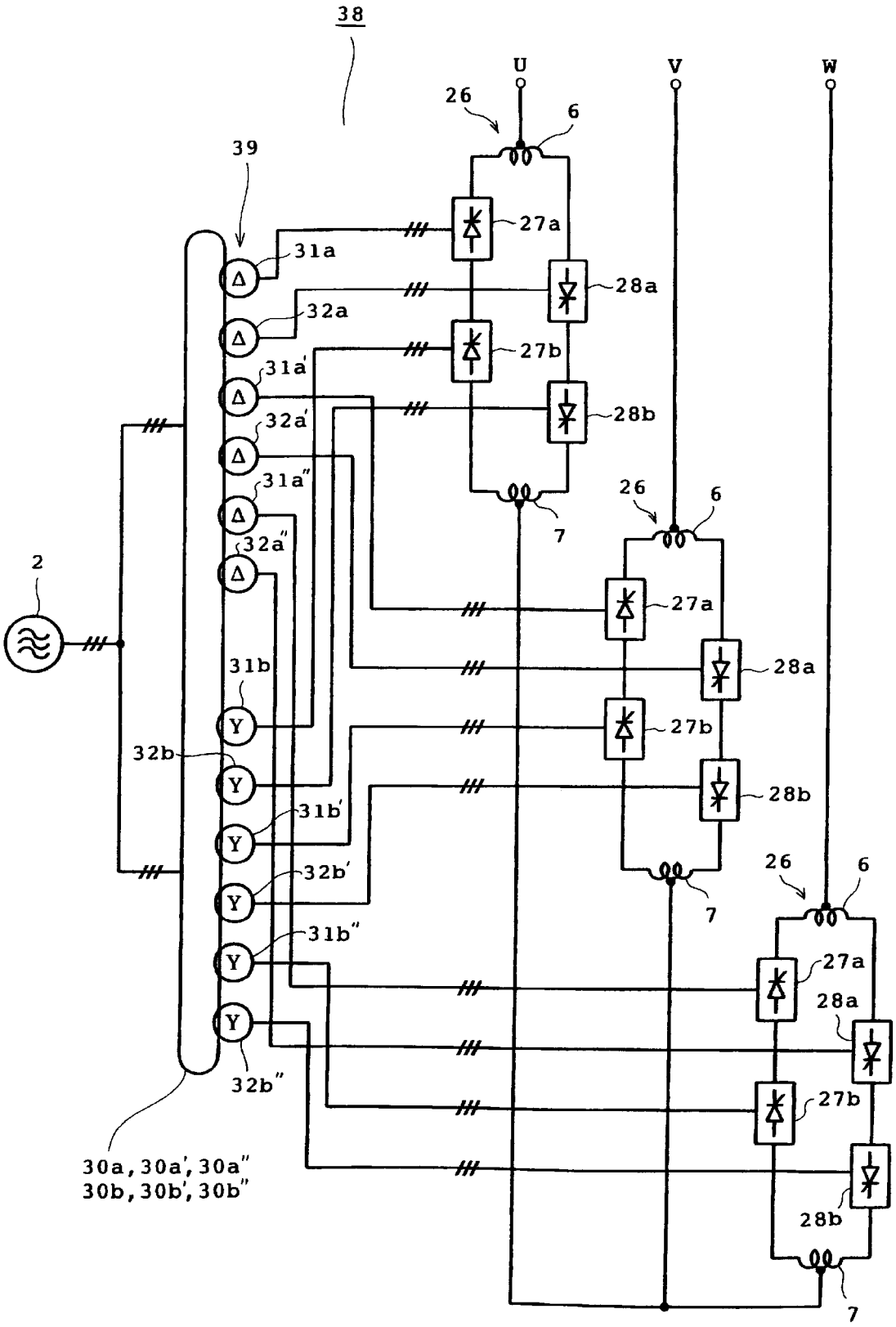
FIG. 17 PRIOR ART
FIG. 17 is an electrical connection diagram of further another prior art three-phase output cycloconverter having a transformer arrangement differing from those shown in FIGS. 13 and 15.
Figure 18:
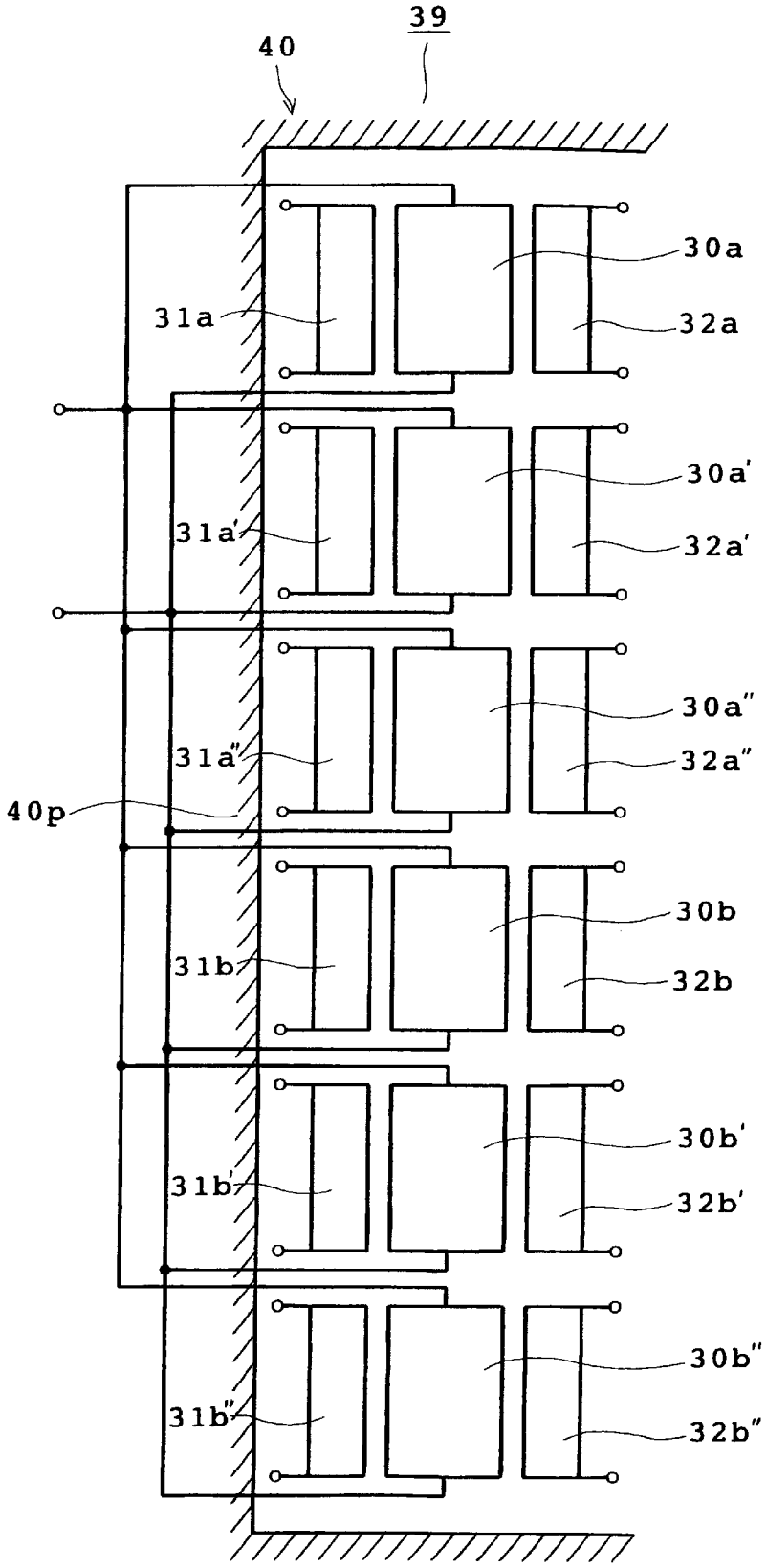
FIG. 18 PRIOR ART
FIG. 18 is a diagrammatic longitudinally sectional view of one leg of the core of one of the transformers used in the cycloconverter shown in FIG. 17.
Figure 19:
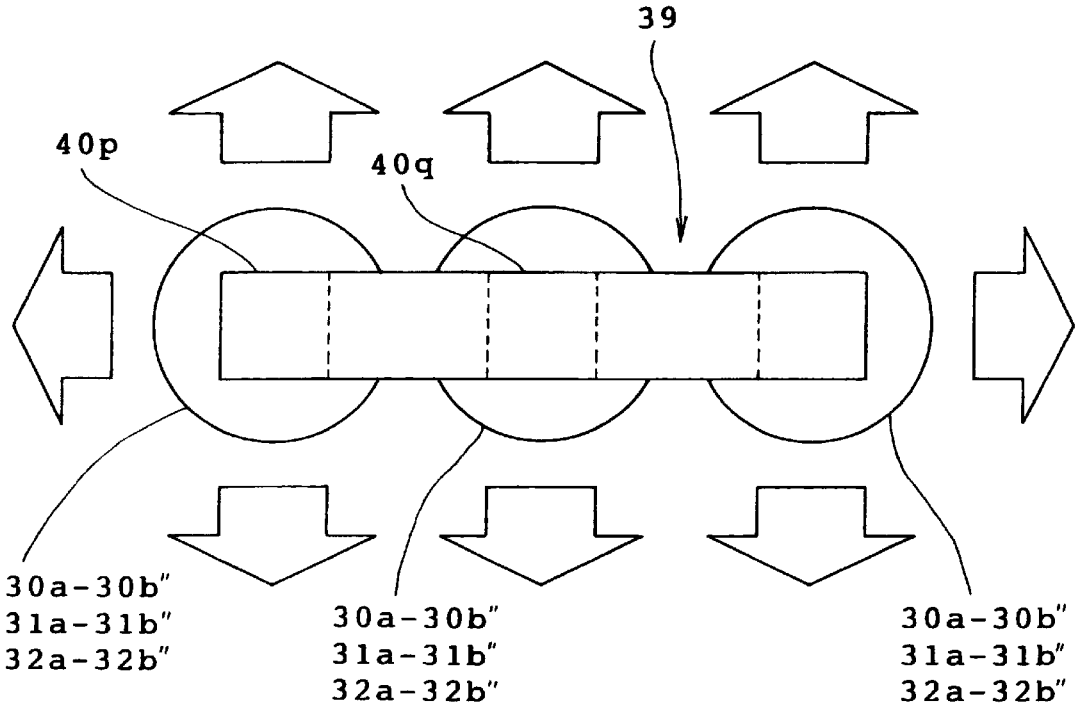
FIG. 19 PRIOR ART
FIG. 19 is a schematic plan view of transformers used in the cycloconverter shown in FIG. 17.
Figure 20:
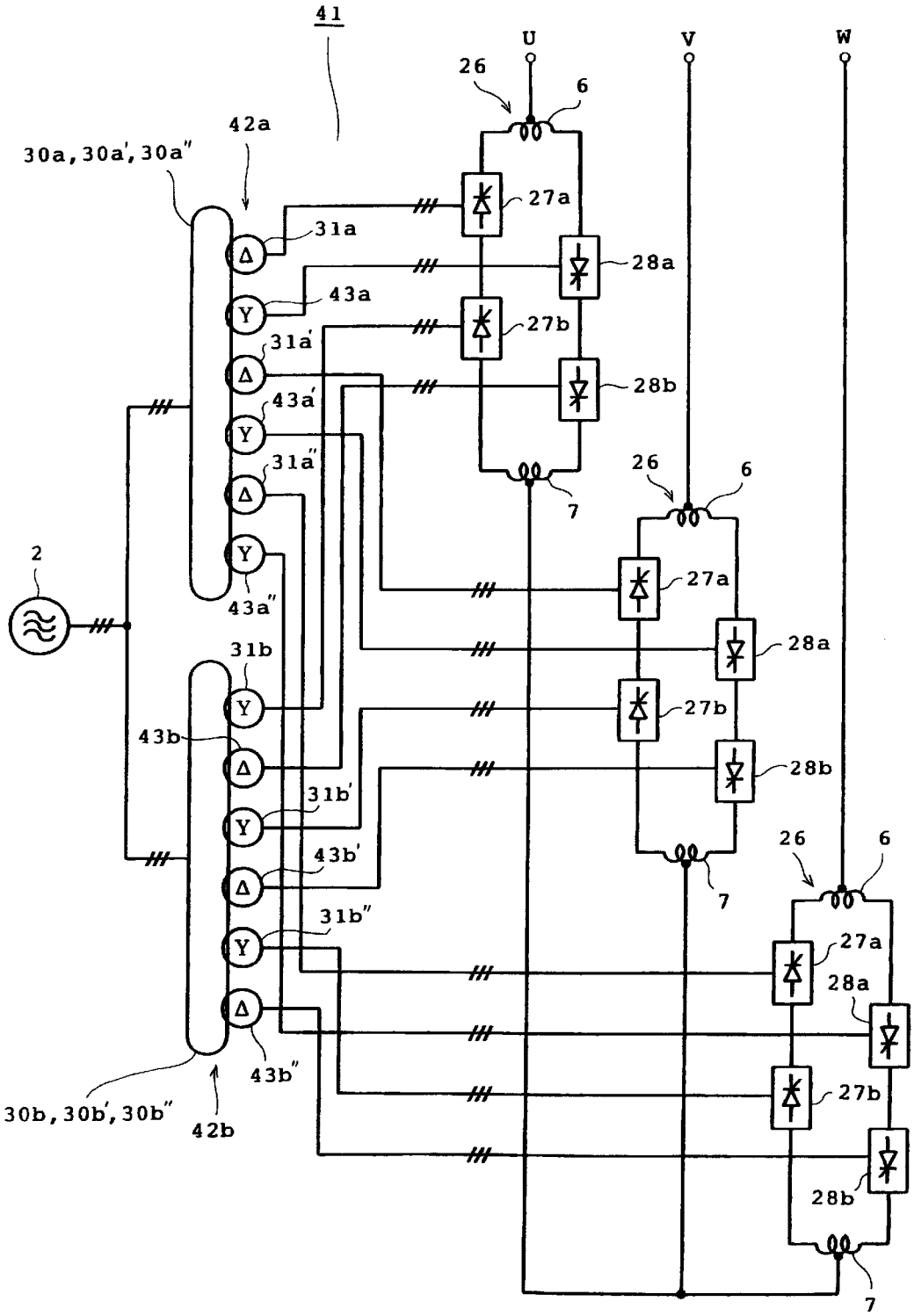
FIG. 20 PRIOR ART
FIG. 20 is an electrical connection diagram of further another prior art three-phase output cycloconverter having a transformer arrangement differing from that shown in FIG. 15.
Figure 21:
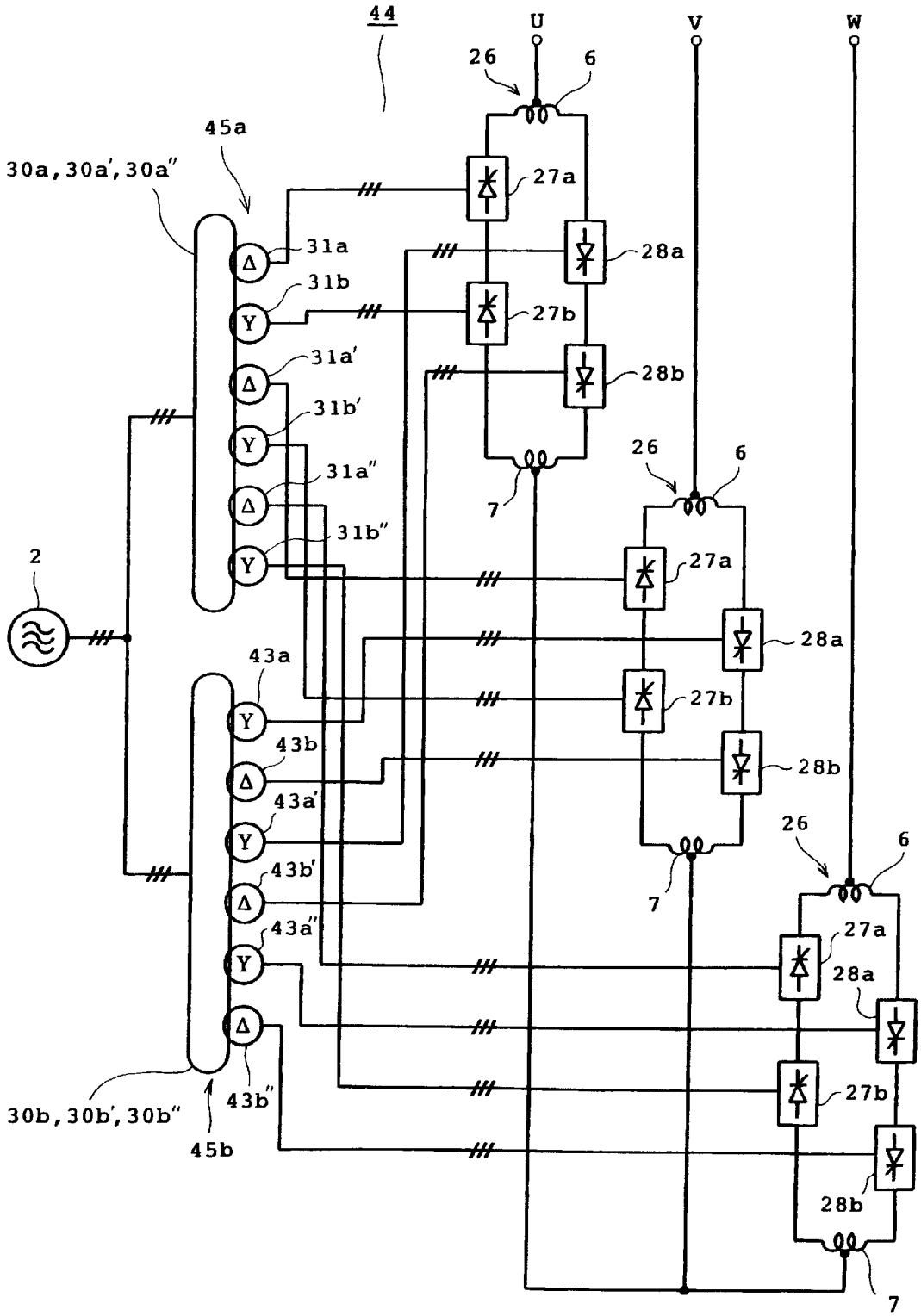
FIG. 21 PRIOR ART
FIG. 21 is also an electrical connection diagram of the three-phase output cycloconverter which is similar to that shown in FIG. 20 but has an arrangement of secondary windings of the transformers differing from that shown in FIG. 20.

FIG. 6A schematically shows the two-legged cores 64 of the three single-phase transformers 62 respectively. FIG. 6C shows the three leg cores 34 of the prior-art three three-phase transformers 29 respectively. A set of windings wound on the leg 64*p*, for example, a set of the first positive group winding 66*a*, the primary winding 65*a* and the first negative group winding 67*a* as shown in FIG. 5 is formed in a generally square shape. Assume that a set of windings wound on the leg 34*p*, for example, a set of the first primary winding 31*a*, the primary winding 30*a* and the first negative group winding 32*a* as shown in FIG. 14 is formed so as to have the same shape and the same dimensions as the above-mentioned winding set wound on the leg 64*p*. In this case, when the cores 64 and 34 of the respective transformers 62 and 29 have the same thickness, the difference between the weights of the cores is proportional to the difference between areas of the cores 64 and 34 as viewed from the front.

In FIG. 6C, reference symbol R designates a width of each leg or the yoke of each three-legged core 34 and reference symbol W designates a width of a window portion. Reference symbol H (=W) designates a height of the window portion. Since three sets of windings are wound on each leg of the two-legged core 64 as shown in FIG. 6A, a width of each window portion is designated by W and a height thereof is designated by 1.5H (=1.5W). As a result, the area of the two leg core 64 as viewed from the front is smaller by 6R(R+W) than that of the three-legged core 34, so that an amount of core material is reduced in proportion to the difference between the areas. Consequently, no-load loss is reduced in each transformer 62 as compared with the prior art transformer 29 as shown in FIG. 13 and a transformation efficiency can be improved.

The primary windings 65*a* to 65*f* are interposed between the positive group windings 66*a* to 66*b*" and the negative group windings 67*a* to 67*b*" respectively in each single-phase transformer 62. This arrangement improves a rate of use of the primary windings 65*a* to 65*f* to the secondary windings 66*a* to 67*b*". In this case, the primary windings 65*a* to 65*f* are magnetically coupled close to the positive group windings 66*a* to 66*b*" and the negative group windings 67*a* to 67*b*". Accordingly, a load current flows into the primary windings 65*a* to 65*f* during energization to either positive or negative group windings 66*a* to 66*b*" or 67*a* to 67*b*". Consequently, the size and the weight of each single-phase transformer 62 can be reduced since a total capacity of the primary windings 65*a* to 65*f* of each single-phase transformer 62 is rendered approximately $\sqrt{1/2}$ times smaller than a total capacity of the secondary windings 66*a* to 67*b*".

In each single-phase transformer 62, the first positive group windings 66*a*, 66*a*' and 66*a*" and the second positive group windings 66*b*, 66*b*' and 66*b*" are wound on the two-legged core 64.

Further, the first negative group windings 67*a*, 67*a*' and 67*a*" and the second negative group windings 67*b*, 67*b*' and 67*b*" are also wound on the two-legged core 64. In other words, the windings connected to the converters 27*a*, 27*b*, 28*a* and 28*b* constituting the converter sections 26 of the respective phases are wound on a single two-legged core 64 so as to form the same magnetic circuit. Accordingly, the two-legged core 64 is excited by the twelve-pulse current through the overall period including a period in which the positive group converters 27*a* and 27*b* supply positive half-cycle voltages and a period in which the negative group converters 28*a* and 28*b* supply negative half-cycle voltages. Consequently, harmonics can be reduced as compared with the case where the core is excited by the six-pulse current and accordingly, the core loss can be reduced.

Figure 7:
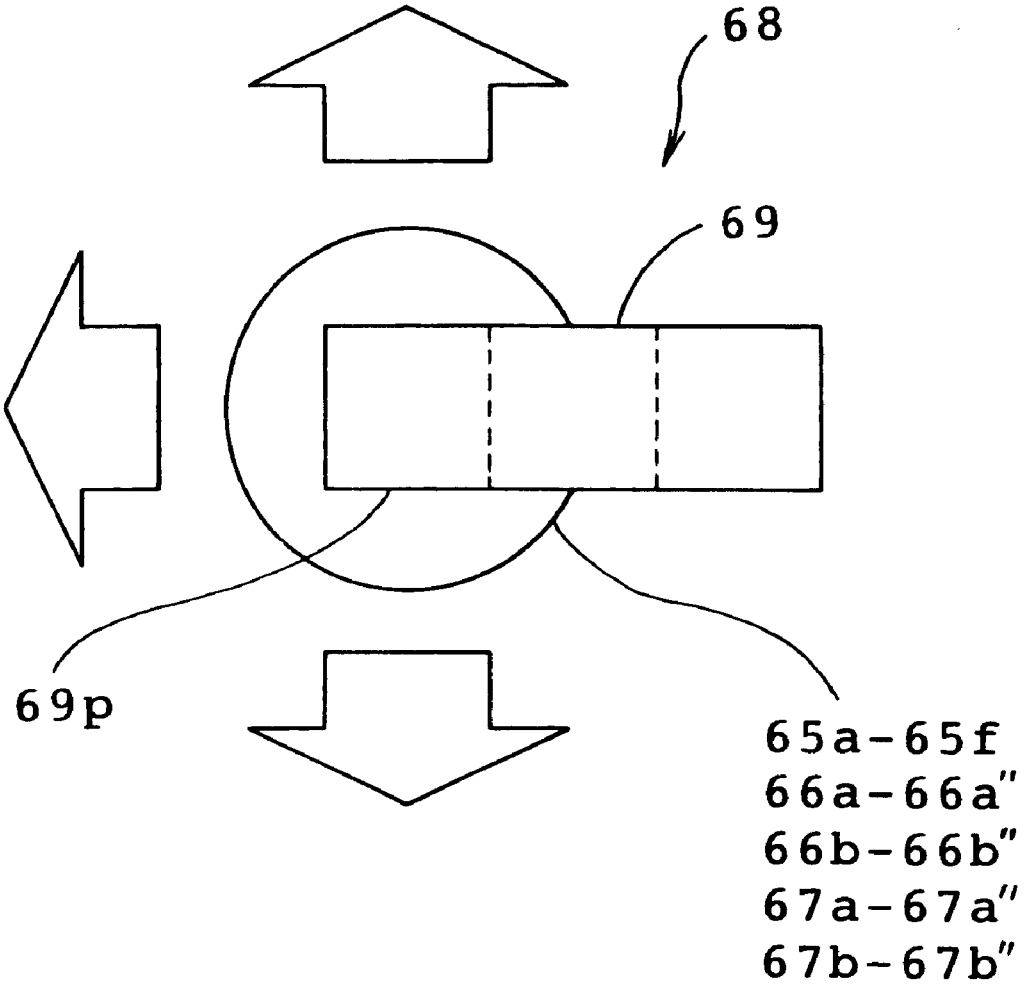
FIG. 7 is a schematic plan view of one of the single-phase transformers of a second embodiment in accordance with the invention.
Figure 8:
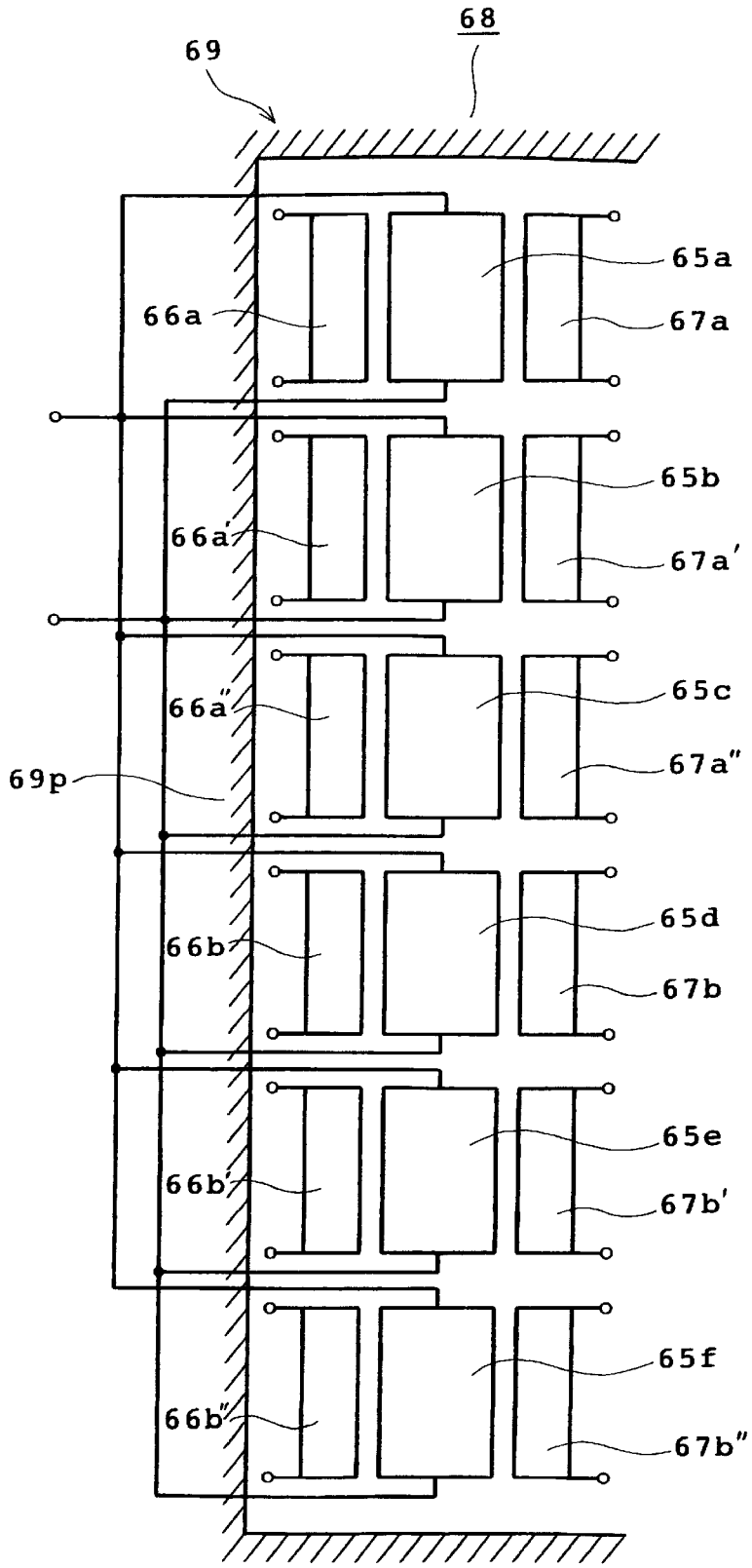
FIG. 8 is a diagrammatic longitudinally sectional view of one leg of the core of one single-phase transformer, showing an arrangement of the windings in the one leg.

FIGS. 7 and 8 illustrate a second embodiment of the invention. The winding arrangement of each single-phase transformer 62 in the foregoing embodiment is modified in the second embodiment. The cycloconverter transformer comprises three single-phase transformers 68 connected in a three-phase arrangement as the transformer 63 in the foregoing embodiment. Each single-phase transformer 68 comprises a two-legged core 69, six primary windings 65*a* to 65*f* wound on one leg 69*p* of the core 69, and twelve secondary windings 66*a* to 67*b*" wound on the leg 69*p* as shown in FIG. 7.

FIG. 8 shows a winding arrangement for the leg 69*p* of the core 69. On an upper portion of the leg 69*p* are wound an innermost first positive group winding 66*a*, a primary winding 65*a* and an outermost first negative group winding 67*a* in this order as viewed in FIG. 8 so that the windings forms a set of windings. Further, five sets of windings each of which is formed by interposing the primary winding between the positive and negative windings are provided on the lower portion of the leg 69*p*. Thus, six sets of windings are formed on the leg 69*p*.

The same effect can be achieved from the above-described arrangement as from the first embodiment. Since all the windings are wound on the core leg 69*p* of each single-phase transformer 68, the number of lead wires extended from the leg 69*p* in each single-phase transformer 68 is larger than in each single-phase transformer 62. However, the lead wires can be extended utilizing the spaces in the three directions shown by respective arrows in FIG. 7. Further, when an amount of core material concerning the three transformers 68 is compared with an amount of core material concerning the three transformers 29 shown in FIG. 13 on the assumption described in the foregoing embodiment, the total area of the three two-legged cores 69 as viewed from the front in the second embodiment is reduced by $2R^2$ as shown in FIGS. 6B and 6C. Consequently, since an amount of core material is reduced in proportion to the difference between the areas, no-load loss is reduced in each transformer 68 as compared with the prior art transformer 29 as shown in FIG. 13 and a transformation efficiency can be improved.

Figure 9:
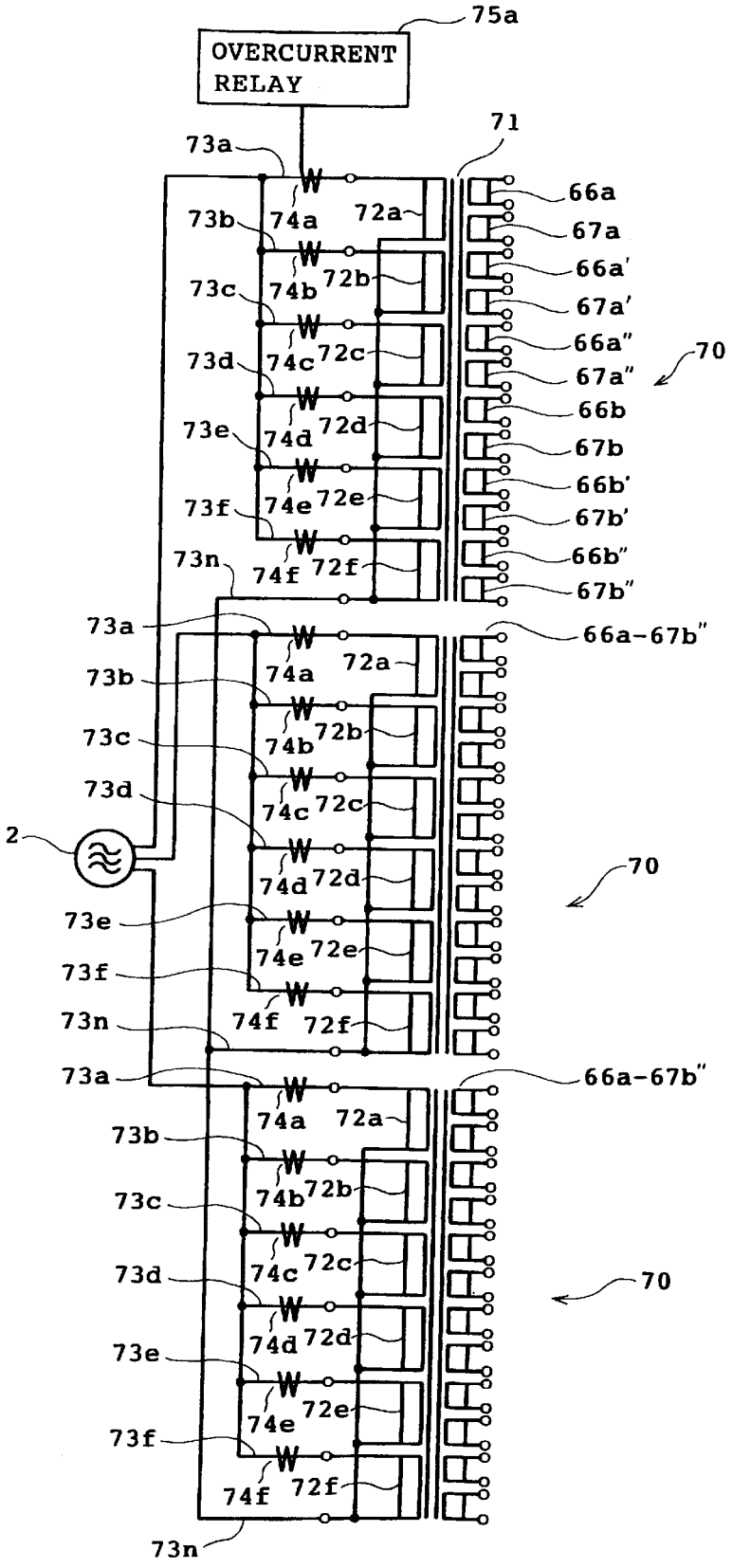
FIG. 9 is an electrical connection diagram of primary windings of the single-phase transformers of a third embodiment in accordance with the invention.

FIG. 9 illustrates a third embodiment. The primary winding side of each single-phase transformer 62 in the first embodiment is modified in the third embodiment. The cycloconverter transformer comprises three single-phase transformers 70 connected in a three-phase configuration as the transformer 63 in the first embodiment. Each single-phase transformer 70 comprises a two-legged core 71, six primary windings 72*a* to 72*f* wound on two legs of the core 71, and twelve secondary windings 66*a* to 67*b*" wound on the two legs of the core 71. In this case, three of the six primary windings are wound on one leg of the core 71, whereas the other three primary windings are wound on the other leg. Further, six of the twelve secondary windings are wound on one leg, whereas the other six secondary windings are wound on the other leg.

FIG. 9 shows an electrical arrangement of the primary winding side of each single-phase transformer 70. In each single-phase transformer 70, one terminals of the respective primary windings 72*a* to 72*f* are connected in common to be extended as a single lead wire 73*n*. The other terminals of the respective primary windings 72*a* to 72*f* are extended individually as six lead wires 73*a* to 73*f* respectively. These lead wires 73*a* to 73*f* are connected to current transformers 74*a*to 74*f* respectively and then connected in common, being further connected to the three-phase AC power supply 2. The current transformers 74*a* to 74*f* constitute overcurrent detectors in the invention with overcurrent relays 75*a* to 75*f* which will be described later, respectively. The lead wires 73*n* of the respective single-phase transformers 70 are connected in common. Accordingly, the primary windings 72*a* to 72*f* of each single-phase transformer 70 constituting the cycloconverter transformer are connected in the wye configuration.

Overcurrent relays 75*a* to 75*f* constituting the overcurrent detectors are connected to the current transformers 74*a*to 74, respectively. Each overcurrent relay opens a circuit when a current value of the corresponding lead wire detected by the respective current transformer exceeds a predetermined value. FIG. 9 shows only one overcurrent relay 75*a* for one of the single-phase transformers 70.

In the above-described arrangement, the six primary windings 72*a* to 72*f* are connected in parallel with one another in each single-phase transformer 70, and the primary windings 72*a* to 72*f* are interposed between the positive group windings 66*a* to 66*b*" such that these windings are magnetically coupled close to one another. Accordingly, when an overcurrent due to a short circuit etc. at the side of the secondary windings 66*a* to 67*b*" flows into the secondary windings 66*a* to 67*b*", a primary current according to the overcurrent flows concentrically into the primary windings magnetically coupled close to the secondary windings. Consequently, a detecting sensitivity for a fault current can be increased.

Although each single-phase transformer 62 comprises the parallel connected six primary windings 65*a* to 65*f* in the foregoing first embodiment, two or three primary windings may be provided for each single-phase transformer, instead. Further, each single-phase transformer 68 may comprise two primary windings in the foregoing second embodiment.

In the third embodiment, the six lead wires 73*a* to 73*f* may be connected so as to be formed into three or more wires according to a required current detecting sensitivity, and a single current transformer common to the lead wires constituting each connected wire may be connected to each wire. For example, when the lead wires 73*a* to 73*f* connected so as to be formed into three wires each composed of two lead wires, only three current transformers are required for each one of the single-phase transformers 70. Further, when the required current detecting sensitivity is low, a single current transformer may be provided so as to be common to the six lead wires 73*a* to 73*f*. In this case, only one current transformer is required for each one of the single-phase transformers 70. Thus, by connecting the lead wires into a suitable number of wires, the number of current transformers can be rendered the smallest while a desired current detecting sensitivity can be obtained.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

I claim:

1. A transformer for a cycloconverter comprising:

three single-phase transformers connected into a three-phase configuration, each of the single-phase transformers comprising:

a two-legged core;

primary windings wound on at least one of legs of the two-legged core; and twelve secondary windings wound on at least one of the legs of the two-legged core, the secondary windings being connected to positive group converters and negative group converters of a three-phase output circulating current type cycloconverter composed of three single-phase output circulating current type cycloconverters connected in a three-phase configuration, each of the single-phase output circulating current type cycloconverters including two positive group converters and two negative group converters arranged in a twelve-pulse bridge configuration;

wherein the single-phase transformers include six sets of the secondary windings of the respective phases each of which sets is connected in a delta configuration and other six sets of the secondary windings each of which sets is connected in a wye configuration.

2. The transformer according to claim 1, wherein six secondary windings of each single-phase transformer are wound on a first leg of the core and the other six secondary windings of each single-phase transformer are wound on a second leg of the core.

3. The transformer according to claim 1, wherein the primary windings of each single-phase transformer are wound on the legs of the core so as to be interposed between the secondary windings connected to the positive group converters and the secondary windings connected to the negative group converters.

4. The transformer according to claim 2, wherein the primary windings of each single-phase transformer are wound on the legs of the core so as to be interposed between the secondary windings connected to the positive group converters and the secondary windings connected to the negative group converters.

5. The transformer according to claim 1, wherein the primary windings of each single-phase transformer include a plurality of parallel connected primary windings, and the primary windings are provided with overcurrent detectors which detect overcurrents flowing into the primary windings respectively.

6. The transformer according to claim 2, wherein the primary windings of each single-phase transformer include a plurality of parallel connected primary windings, and the primary windings are provided with overcurrent detectors which detect overcurrents flowing into the primary windings respectively.

7. The transformer according to claim 3, wherein the primary windings of each single-phase transformer include a plurality of parallel connected primary windings, and the primary windings are provided with overcurrent detectors which detect overcurrents flowing into the primary windings respectively.

8. The transformer according to claim 4, wherein the primary windings of each single-phase transformer include a plurality of parallel connected primary windings, and the primary windings are provided with overcurrent detectors which detect overcurrents flowing into the primary windings respectively.

* * * * *